United States Patent [19]

Fuhrig

[11] Patent Number: 5,046,667

[45] Date of Patent: Sep. 10, 1991

[54] AUTOMATIC SPRAY NOZZLE

[75] Inventor: Wolfgang Fuhrig, Wiesbaden, Fed. Rep. of Germany

[73] Assignee: Oeco-Tech Entwicklung und Vertrieb Von Verpackungssystemen GmbH, Wiesbaden, Fed. Rep. of Germany

[21] Appl. No.: 406,406

[22] Filed: Sep. 12, 1989

[30] Foreign Application Priority Data

Sep. 28, 1988 [DE] Fed. Rep. of Germany ..... 3832852

[51] Int. Cl.[5] ..... B05B 7/24; B05B 11/02; B65D 83/44

[52] U.S. Cl. ..... 239/124; 239/323; 239/351; 239/355; 239/373; 222/399; 222/400.5

[58] Field of Search ..... 222/399, 400.5, 400.8; 239/124, 323, 346, 351, 355, 361, 365, 373

[56] References Cited

U.S. PATENT DOCUMENTS

| | | | |
|---|---|---|---|
| 2,953,304 | 9/1960 | Sellinger | 239/323 X |
| 3,565,344 | 2/1971 | Takei et al. | 239/373 X |
| 4,155,509 | 5/1979 | Koyama | 239/373 X |
| 4,159,081 | 6/1979 | Demler et al. | 239/323 |
| 4,174,811 | 11/1979 | Binder et al. | 222/399 |
| 4,222,525 | 9/1980 | Hilderbrandt | 239/351 X |
| 4,519,528 | 5/1985 | Comment | 222/399 X |
| 4,972,975 | 11/1990 | Fuhrig | 239/373 X |

*Primary Examiner*—Andres Kashnikow
*Assistant Examiner*—William Grant
*Attorney, Agent, or Firm*—Biebel & French

[57] ABSTRACT

A spray apparatus is described for spraying liquid products having a products container disposed in a casing cover. A spray head is provided with a products channel, and an air supply line connected to a pressure connection of an air pump. The spray head has a closure part, a control part displaceable towards the closure part and mechanisms for introducing compressed air into the nozzle of the spray head. The spray apparatus rapidly reduces the compressed air producing the spray jet when the spray apparatus is switched off, so that there is no subsequent spraying or dripping. In order to rapidly reduce the compressed air, the closure part has a slide valve provided with pipe connections, and a control slider is positioned in the slide valve and is movable by means of the control part. The spray apparatus has a spraying position, a venting position, and a closure position, such that when in the closure position, the control slider is disposed in its uppermost position where it projects furthest out of the slide valve.

19 Claims, 12 Drawing Sheets

(A)

AUTOMATIC SPRAY NOZZLE

Figure 1:
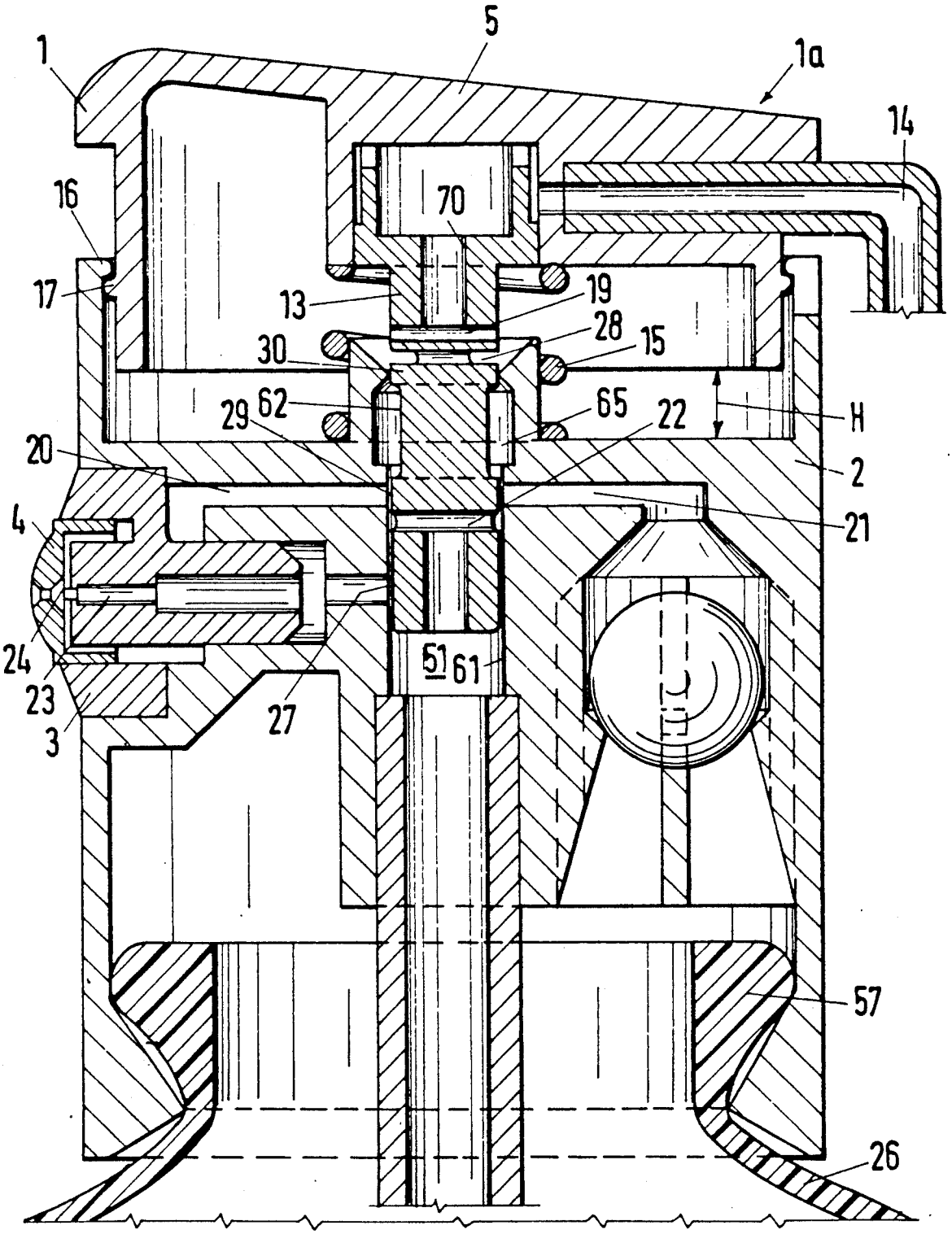

The invention relates to a spray nozzle for spraying or frothing liquid products having a products container disposed in a casing cover and having a spray head which is provided with a channel for the products and an air supply line, wherein the latter is connected to the pressure connection of an air pump, the spray head has a closure part, a control part which is displaceable towards the closure part, and mechanisms for introducing compressed air into the nozzle of the spray head.

Many kinds of spray nozzles are known for spraying liquids, e.g. hair care preparations, medication or general cosmetics. These liquids to be sprayed were originally ejected from the products containers by means of hand pumps and later by means of propellant gases, and most recently another kind of hand pump has been reverted to in order to avoid harm to the environment caused by propellant gases.

Automatic spray nozzles are known where the air pump is in the form of a diaphragm pump which is driven by an electric motor. This has led particularly when air pumps are used, to the end user experiencing an appreciable ease in operation, but the technique of the jet of spray is adversely affected. It has been established, for example, that when there are differing pressures of the compressed air produced, and also when there are varying flow volumes of this compressed air, spray jets are produced of varying particle size. Therefore, efforts have already been made to create constant flowing spray jets.

With the motor driven air pumps of known spray nozzles, a further disadvantage has been observed, namely that when the pump is first switched on an air current begins which has a low pressure, and only after a certain time delay can the pressure be brought to a maximum operational value with a maximum volume of flow. Even when the pump is being switched off, it has been seen that the spray jet is not immediately interrupted, but is reduced slowly only after the air volume and air pressure have been reduced. It has hitherto not been possible to develop known designs for spray nozzles to avoid the above-mentioned drawbacks satisfactorily, nor to put them on the market, and as a rule they have been too complex technically.

The aim of the invention is therefore to improve an automatic spray nozzle with the features mentioned in the introduction, such that in particular when switching off the pump the compressed air which produces the spray jet is promptly reduced so that there is no subsequent spraying or dripping.

The above problem is solved according to the invention in that the closure part has a slide valve which is provided with pipe connections, the slide valve including a control slider movable by means of the control part, and pre-stressed by a return spring, and having passages and sealed reinforcements for air and liquids, limited by stops on a stroke, is movably held in such a way that in the spraying position when the return springs are compressed the pipe connections in the closure part are connected to the passages of the control slider for air and liquids, and in an adjacent venting position when the return springs are partially relaxed the pipe connections in the closure part are partially separated and are partially disposed so that they are connected to the air vent pipes leading to the atmosphere, and in that in the closure position when the return springs are at maximum relaxation the control slider is in its uppermost position in which it projects furthest out of the slide valve. The spray nozzle according to the invention is thus provided with a special closure part which closes by means of a sealing at the opening of the products container, which opening is preferably disposed at the upper end of the products container. In this specially equipped closure part there is located the afore-mentioned slide valve from which pipe connections emanate, and in the slide valve there is disposed the movable control slide. Each spray nozzle has a closure part, wherein there is if possible arranged in this closure part a spray nozzle, but according to the invention the movable control slider ensures that the pipe connections in the closure part which emanate from the slide valve the thereof and provide the spray nozzle with both liquids on the one hand and with compressed air on the other hand, are partially closed or are connected to the corresponding flow means sources.

According to the invention it is particularly advantageous if a venting position is arranged next to the spray position on the one hand and next to the closure position on the other hand. The venting position preferably lies between the spraying position and the closure position. The three operating positions mentioned are a result of the respective positioning of the control slider. The return spring can only bring the spool control slider out of the spraying position and thus into the closure position, after the venting position has been by-passed. Thereby, the supply lines are connected by air to the outer atmostphere so that there is an immediate reduction in pressure, and the lines for the supply of liquids are also simultaneously blocked. However, according to the invention after the spray has been switched off or after the spraying operation has ended the pressure is promptly and immediately reduced so that no liquid drips from the nozzle. Activation of the new spray nozzle is also considerably easier according to the invention because when the operator presses down the spray head he must firstly bring the control slider into the venting position, and then the spraying position is reached, so that the spray jet comes out of the nozzle straight away, i.e. the jet begins promptly and is interrupted promptly. This kind of spraying feature is of particular significance if the spraying is being done at short intervals, such as for example when styling hair, and when lacquering paint etc. Without using environment unfriendly propellant gases a spray nozzle has therefore been created which has the same function as the genuine "aerosols", because the whole spraying process is the same as when using propellant gases, and in particular any subsequent spraying is prevented.

It is particularly advantageous if according to the invention there is disposed between the air passage of the control slider and its passage for liquids a lower sealed reinforcement for closing the pipe connection for air which is disposed in the closure part when the control slider is in the closure position. The control slider is thereby particularly advantageously structured because the individual passages which are to be separated from one another are separated by swollen like portions which can be used simultaneously as sealing means e.g. for closing an air supply line.

The control slider is activated or displaced by pressure being exerted by the fingers of the end user or of the operator who places his finger on top of the finger surface of the control part and displaces the control part against the force of the return springs together with the control slider downwardly in the direction of the products container. If the user releases his finger, then the return spring pushes both the control part and the control slider back into the starting position, wherein the maximum stroke is limited by the stops. The return spring can for example be a spiral spring which when fully relaxed is still tensioned so that the control part is held against the afore-mentioned stop in the starting or closure position. Thus, it can also be appreciated that in the spraying position the control slider is at its furthest in the slide valve of the closure part, and the return spring is maximally compressed, and that therefore the return springs could still be compressed further, though this is undesirable.

Depending on the position of the control slider the tube passages are therefore opened or closed, and this for the compressed air which is produced in the way described by the motor driven air pump, or on the other hand also for the liquid. Therein it is expedient if the air pressure is also used to convey the liquids. For example, when the control slider is opened the compressed air can be brought into contact with the inner space of the products container, in such a way that pressure is brought to bear on the level of liquid of the product, and this thus pushes the liquid through a feedpipe which is connected to the products channel and hence into the spray nozzle.

Therein it is advantageous if the air passage of the control slider is formed by a recess which extends in the longitudinal direction of the air passage at least over the stroke length in the surface of the control slider. With the basically cylindrical casing-like surface of a preferably cylindrically designed control slider, this kind of recess can for example be provided by a reduction in diameter above a certain height of the cylinder. Thereby, air can also flow past the annular seals if the annular sealing which generally operates on a sealed reinforcement reaches the region of a recess of this kind, namely by displacing the control slider inside the slide valve of the closure part.

The spray nozzle according to the invention is also designed advantageously if at the end of the slide valve on the closure part, which end faces the control part there is disposed an annular seal to cooperate with the surface of the control slider outside the air supply channel thereof in the closure position. In order to activate the individual pipe connections to bring about the supply of compressed air and liquid onto the spray nozzle, it is possible by means of the sealed reinforcement of the control slider to seal off the spaces if as described above an annular seal is provided at the closure part, which, depending on the position of the control slider is in engagement with a sealed reinforcement, so that a pipe passage is interrupted, or the sealed reinforcement is disposed outside the annular seal so that the closure is preserved and the pipe connection is produced instead.

It is also advantageous according to the invention if between the air supply channel of the control slider and the air passage thereof there is formed an upper tight reinforcement-preferably with a vent recess-to cooperate with the annular seal disposed on the closure part. This upper sealed reinforcement, unterrupted by individual pipe outlets alone, can extend over the whole of the upper end of the slider which is lastly mounted to the control part.

A preferred embodiment is provided with the feature wherein the oblong slide valve in the closure part is disposed centrally and parallel to the longitudinal central axis of the closure part, in that the pipe connections of the closure part extend vertically radially to the slide valve, in that the products channel is provided in an extension of the slide valve downwardly to the side of the closure part which is oppositely disposed to the return spring, in that the control slider is longer than the slide valve and in that there are provided passages for air and liquids which extend in both ends of the control slider in the centre of the longitudinal axis thereof, and which open into radially extending channels, and finally in that the downflow end of the air supply line is connectable by means of the control slider to the inner space of the products container. A design of this kind is technically particularly favourable to manufacture and also results in the best functional use because the end user general pushes his finger on the centre of the finger surface, and in the case of the embodiment described above the control slider is disposed directly below it. Thus, axial forces operate so that closure can be maintained as small as possible, and the design with the closure part, control slider and control part is subject to hardly any wear. Furthermore, it is advantageous if according to the invention the products container is movably disposed in the casing cover and is held on a sprung shift finger which is pre-stressed against the casing cover to activate a motor, switch. The wish to suddenly or promptly produce a spray jet on exerting finger pressure, and conversely to interrupt the spray jet after releasing a control part is particularly favoured if the motor switch for the air pump is switched on or off at the correct moment. In a preferred embodiment the casing cover receives in the closed lower part thereof the drive aggregates with the battery, motor, switch and air pump, and the products container is loaded in the upper part with the afore-mentioned energy supply. By means of friction, the products container rests securely in the casing cover. Therefore, friction between the outer wall of the products container and the inner wall of the casing cover is kept so low that when the fingers exert pressure on the control part, the whole products container is displaced downwardly whereby the motor switch is activated.

It is advantageous if the shift finger is secured to a displaceable guide pin, which is supported against the bottom of the casing mounted to the casing cover by means of a switch spring. The base of the casing separates for example the energy part from the receiving space for the products container. The base of the casing can have an opening in which the afore-mentioned guide pin is displaceably held and is pre-stressed by the switch spring. A sealing membrane can extend for example over the guide pin, the switch finger and the motor switch so that no liquids, dirt or the like can enter the energy part below the base of the casing, although the space above is accessible to the end user, so that he may, for example, push the products container from above into the casing cover onto the switch finger.

If a further feature of the invention is also observed whereby the switch spring is harder than the return spring which pre-stresses with springing the control slider against the closure part, then the control slider will move firstly and then the motor for the air pump will be activated, or when switching off, if there is still compressed air, the supply of flow means is blocked by the slider and once this happens the air pump is switched off.

It is advantageous if the invention is designed also so that a pipe connection in the closure part is in connection with the products container via a valve mechanism. This embodiment relates to the pipe connection which supplies the liquid to the spineffect nozzle. This pipe connection thus connects the spineffect nozzle on the one hand with the inner space of the products container on the other hand. The valve mechanism according to the invention ensures that depending on the position of the spray nozzle the valve of the afore-mentioned pipe connection closes or is kept open. If the spray nozzle is held upside down i.e. with the spray head below and the energy part in the casing cover at the top, then the liquid would also try to flow down into the spray head. The valve mechanism mentioned here ensures that the liquid product is prevented from flowing out into the spineffect nozzle without the control part being activated. The pipe connection which is to be closed is necessary in order to load the inner space of the products container with air, so that this compressed air pushes the product through the feedpipe into the nozzle.

The afore-mentioned valve mechanism has, according to another advantageous embodiment, a ball cage, preferably supported by means of a runner which is supported on a retaining cam and which is held on the inside annularly, against a ball made of steel or the like, which is movable towards a tight seat. Whatever the position of the spray nozzle, and therefore whatever the position of the products container, liquid can therefore flow through the pipe connection which is an air supply channel, into the air pump. If the container is held horizontally or on its head then the steel ball rolling in its sealed seating prevents liquid from entering the air supply channel.

A further embodiment of the invention is characterised in that in the products container there is secured a foil container which can be filled with liquids, the outlet of which container is sealed and connected to the products channel, wherein the upper end part of the control slider which is connected to the control part of the spray head is closed and without a passage for air, and wherein the downstream end of the air supply line opens into the inner space of the products container and at least one pipe connection of the closure part is connected to the inner space of the products container. With this embodiment the upper end of the control slider is no longer provided with a channel which runs through the middle e.g. for the supply of air, but is formed so that it is closed, for example, solidly. The compressed air can therefore no longer be conveyed from the outside via the control slider and the slide valve in the closure part to the spray nozzle. Instead of this, the afore-mentioned pipe connection in the closure part i.e. the air supply channel between the slide valve and the inner space of the products container is used to convey compressed air from the products container which is located outside the foils container into the spray nozzle. The liquid on the other hand enters the spray nozzle via the products channel from the foil container. The advantage of this embodiment is the fact that the value mechanism mentioned hereinbefore is not necessary, and in particular the valve mechanism comprising the ball cage. The liquid is here contained in the foils container alone, so that the inner space of the products container which is disposed outside the foils container is dry. Even when the spray nozzle according to the invention is disposed so that it is on its head, it is not possible for liquid to enter the spray nozzle unintentionally. Displacement of the control slider can ensure that the spray jet begins promptly and ends just as suddenly when the user so desires, and is controlled by finger pressure.

A further embodiment of the invention is characterised in that in the products container there is secured a foil container which can be filled with liquids, the outlet of which is sealed and connected to the products channel, wherein the foil container is provided with a check valve connected to the downstream end of the air supply line, and is provided with a feedpipe, and wherein the products container can only be opened above the products channel by means of the control slider. The check valve ensures that the air pump can form a cushion of air inside the foils container which bears on the liquid product or the level of liquid thereof, and thus conveys the liquid through the feed pipe in the desired manner into the spray nozzle, if the control slider so allows. The inner space of the products container is again dry and benefits from the advantages mentioned hereinbefore.

A further embodiment of the spray nozzle according to the invention is characterised in that as above in the products container there is secured a foil container which can be filled with liquids, the outlet of which foil container is sealed and connected to the products channel, in that the downstream end of the air supply line is connectable by the control slider to the inner space of the product container, and in that the products container can only be opened above the products channel by means of the control slider. The compressed air in this embodiment operates from the outside on the foils container and therefore pushes the liquid into the spray nozzle according to the position of the control slider. The air which is in the inner space of the products container cannot be directly conveyed from the products container into the spray nozzle. For this to occur, use is made of the slide valve disposed in the centre at the upper end of the control slider, which slide valve conveys air over a radially extending channel into the spray nozzle.

If the casing cover is provided with an orientation screen which reduces its cross-section; in accordance with which the products container has a recess on the outside, then the end user finds that use of a new products container is facilitated by changing it over, because the rotational position is always exactly right so that an air inlet of a products container provided at the bottom of a corresponding embodiment always fits exactly on an end of an air pipe on the air supply line.

The feed pipe is admittedly known "per se" from other spray nozzles and it can also be used with most of the afore-mentioned embodiments of the invention. It can partly be in the form of a feedpipe, and in the case of the embodiment with the check valve in the foils container can be in the form of a tube, to the outlet of which feedpipe there is preferably mounted a weight, so that the outlet of the feed pipe is always in the volume of foils container in which the product is also contained, so that irrespective of the position of the spray nozzle as a whole, the desired functioning can always be ensured i.e. the spray jet will start promptly when activated and will be interrupted when the control part is released.

Figure 2:
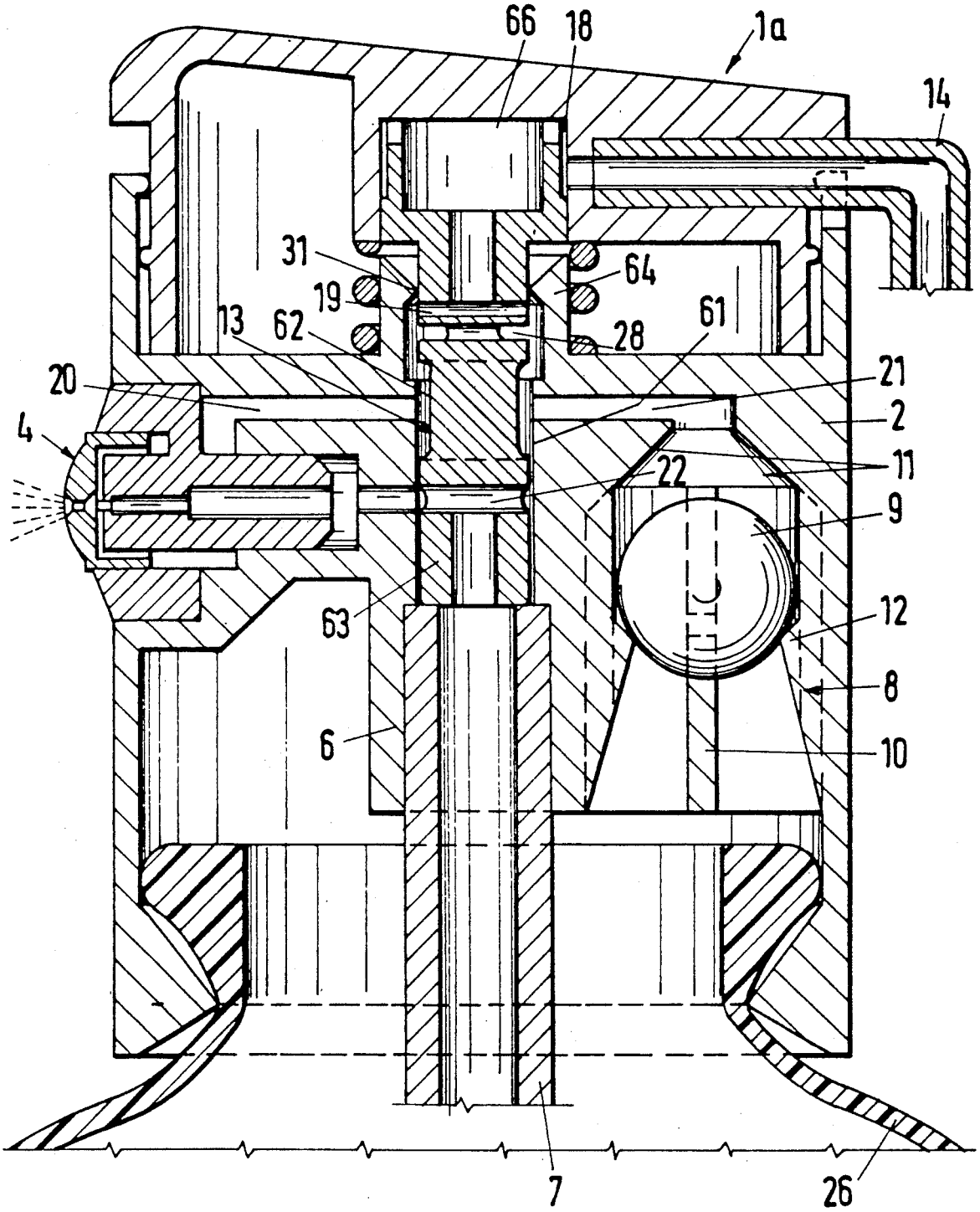
Figure 3:
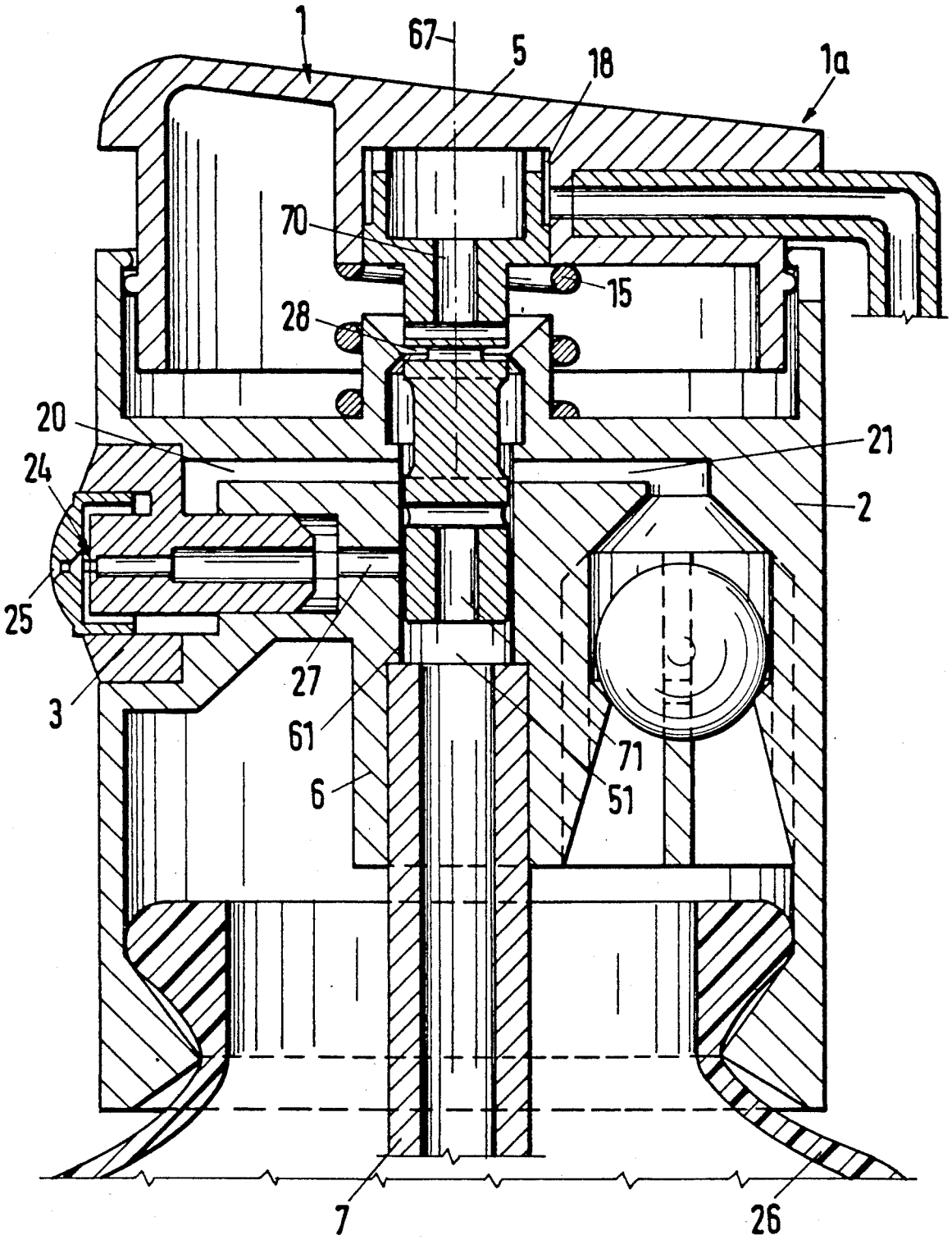
Figure 4:
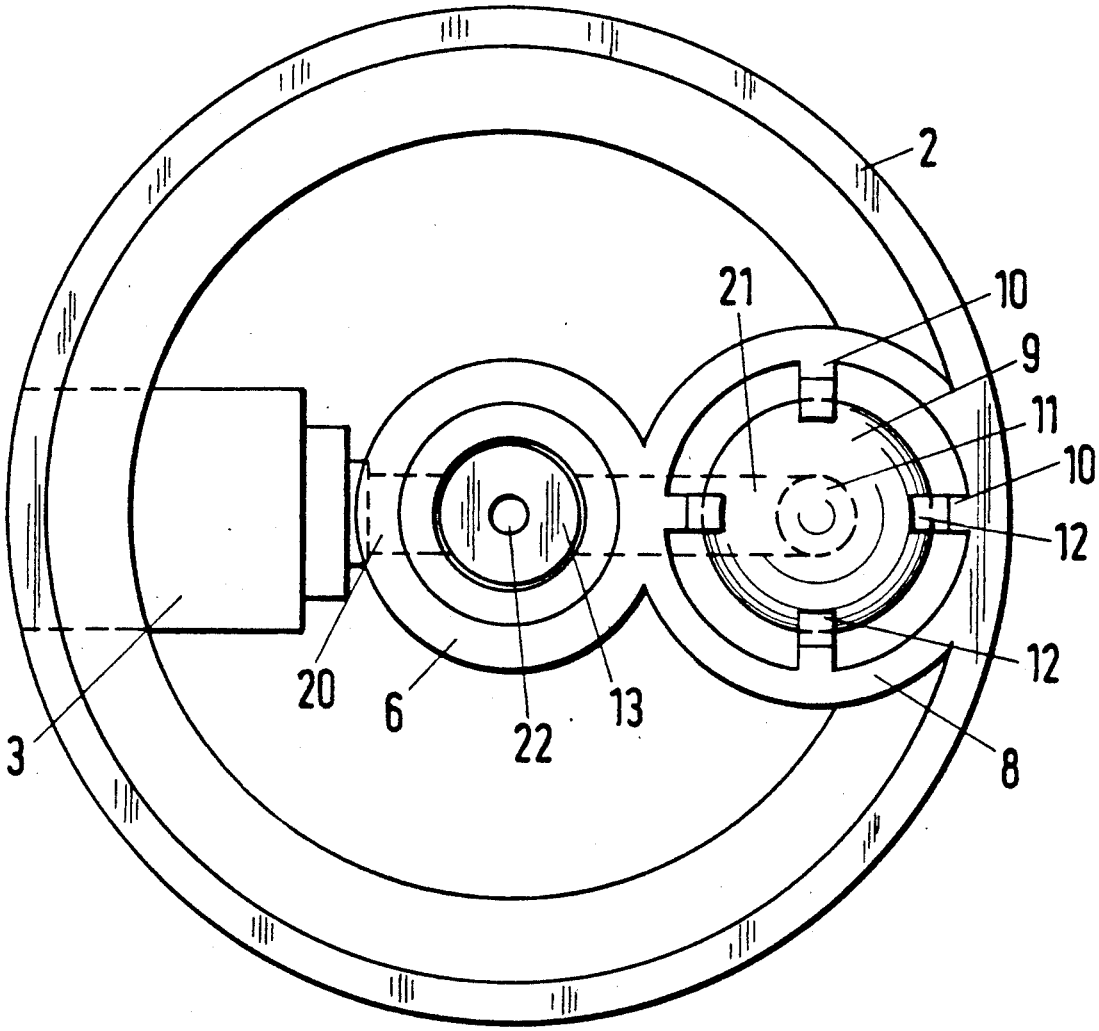
Figure 5:
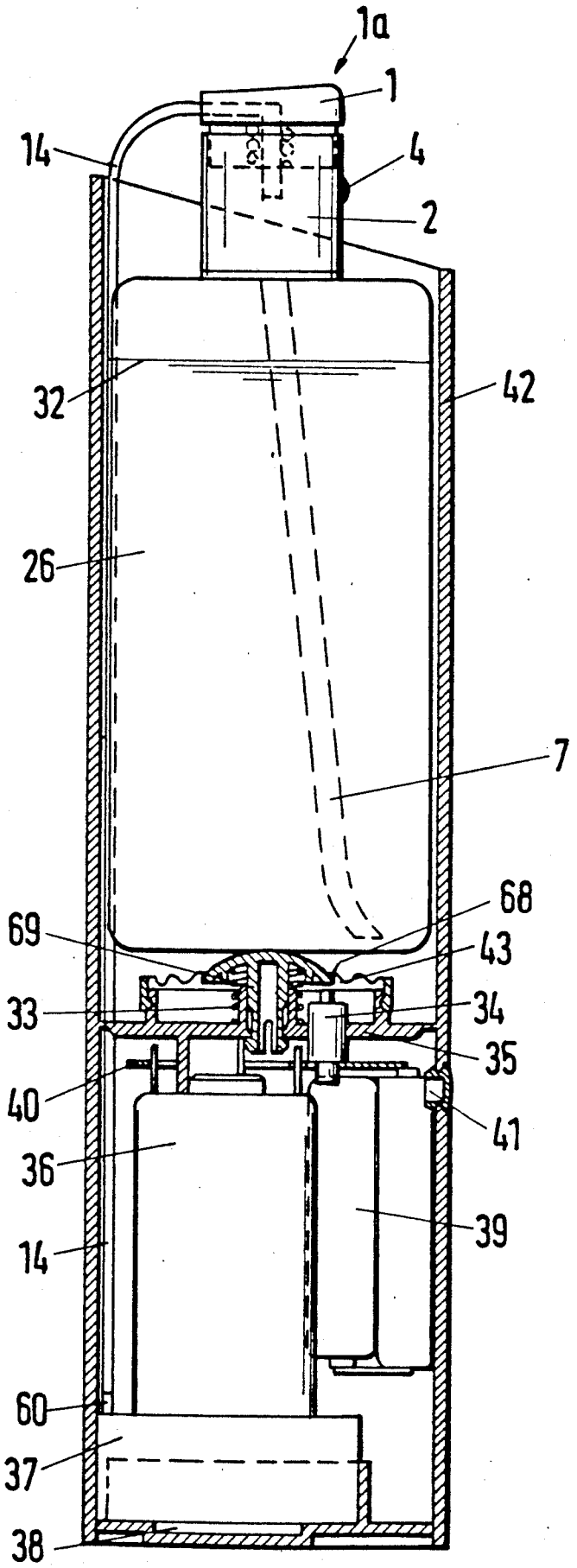
Figure 6:
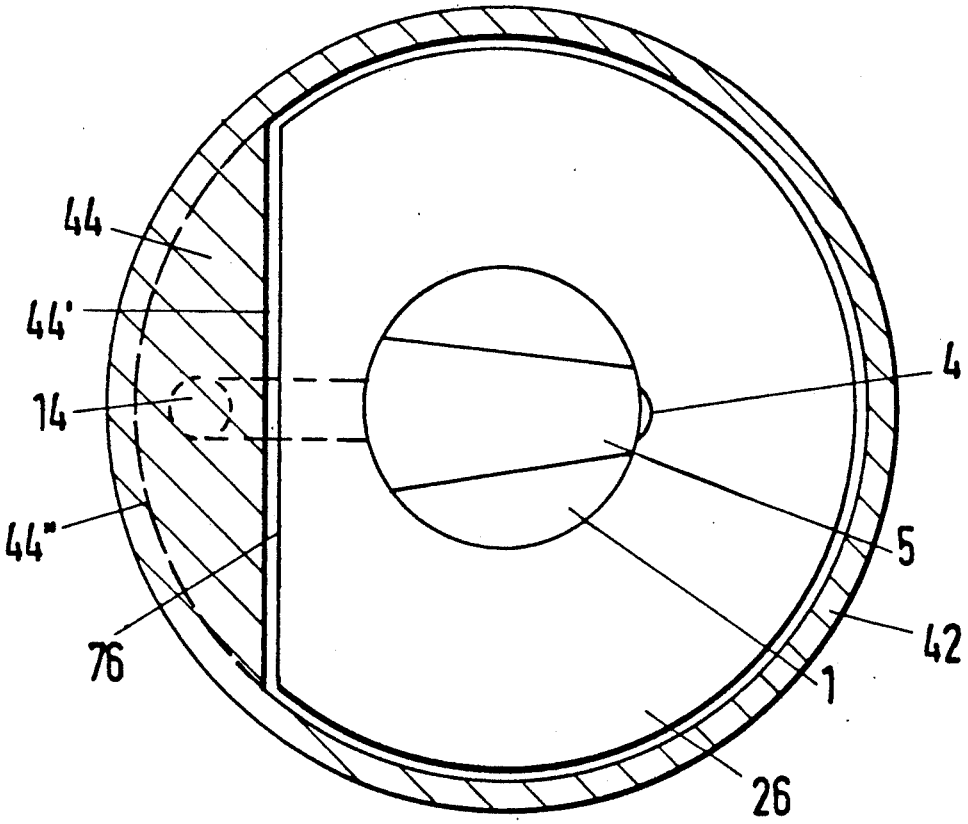
Figure 7:
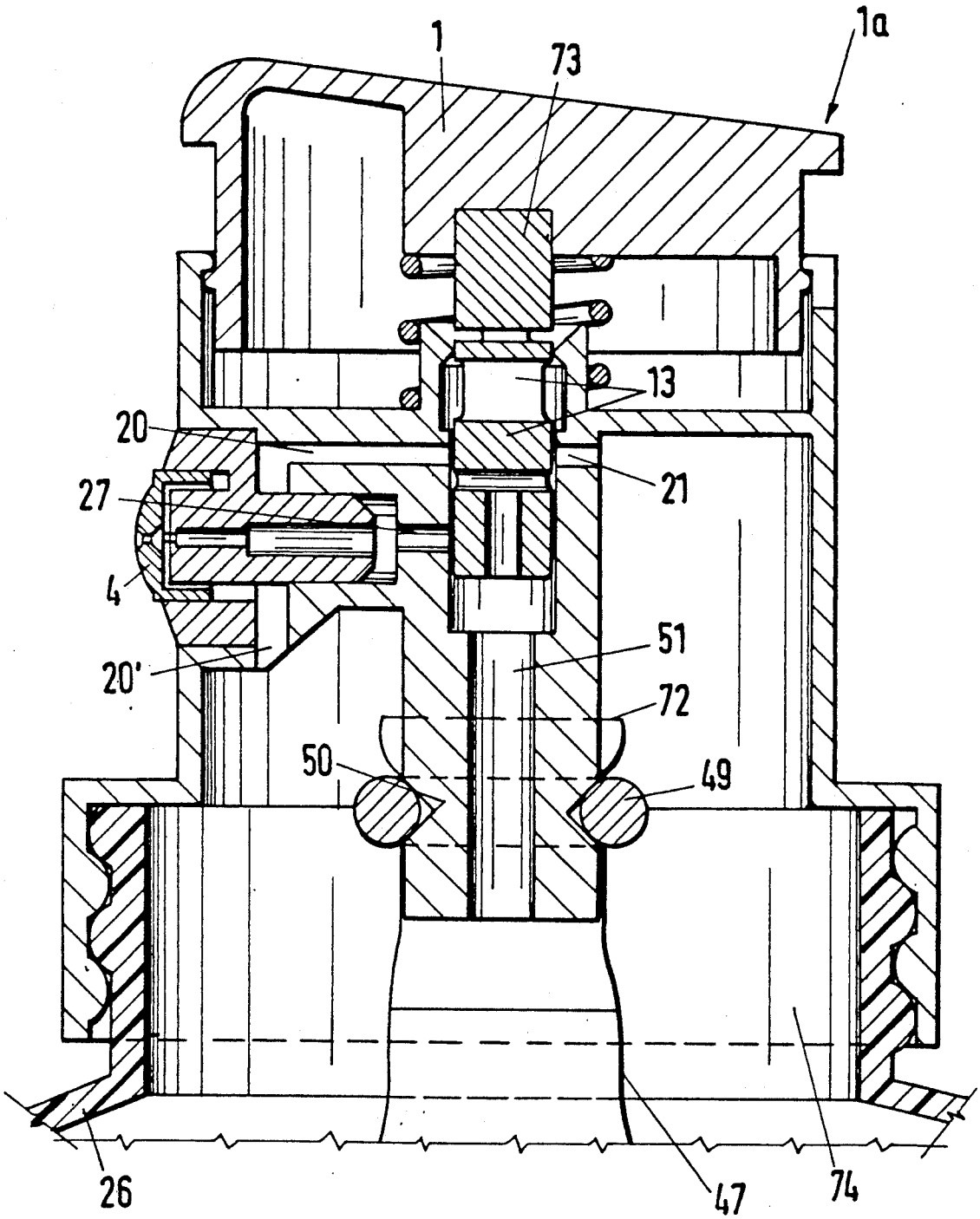
Figure 8:
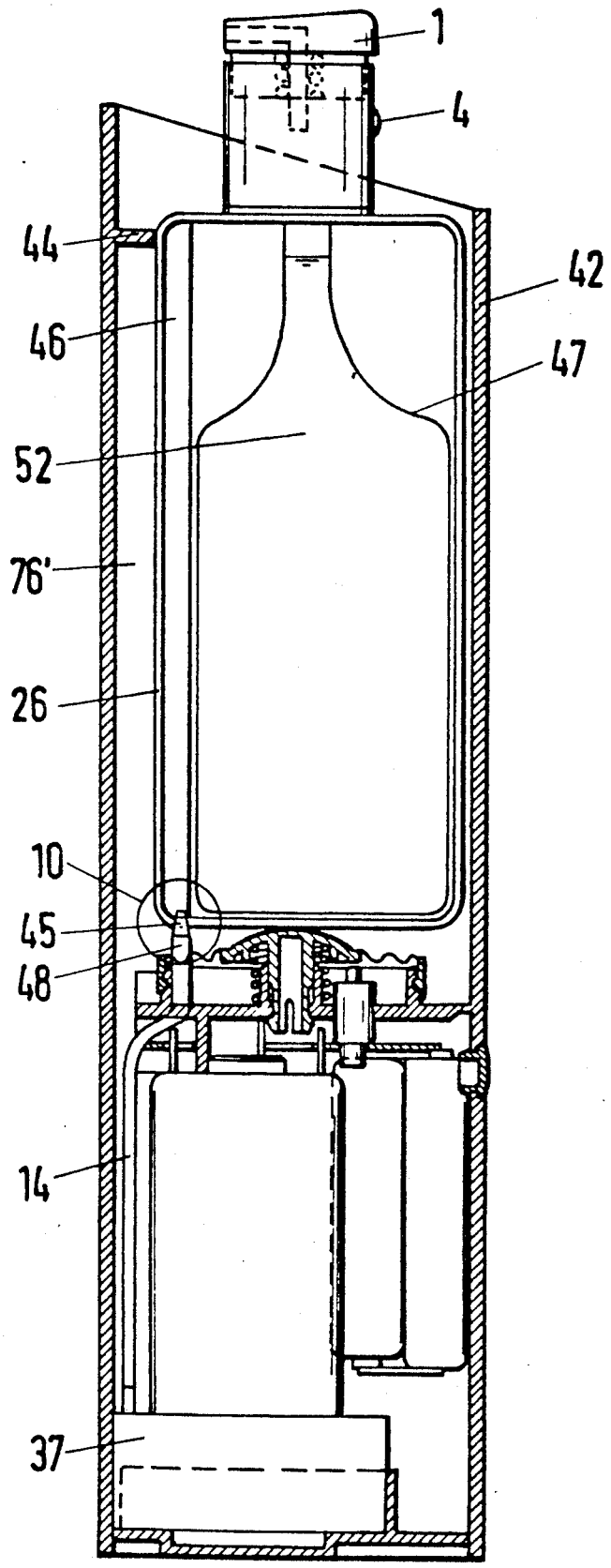
Figure 9:
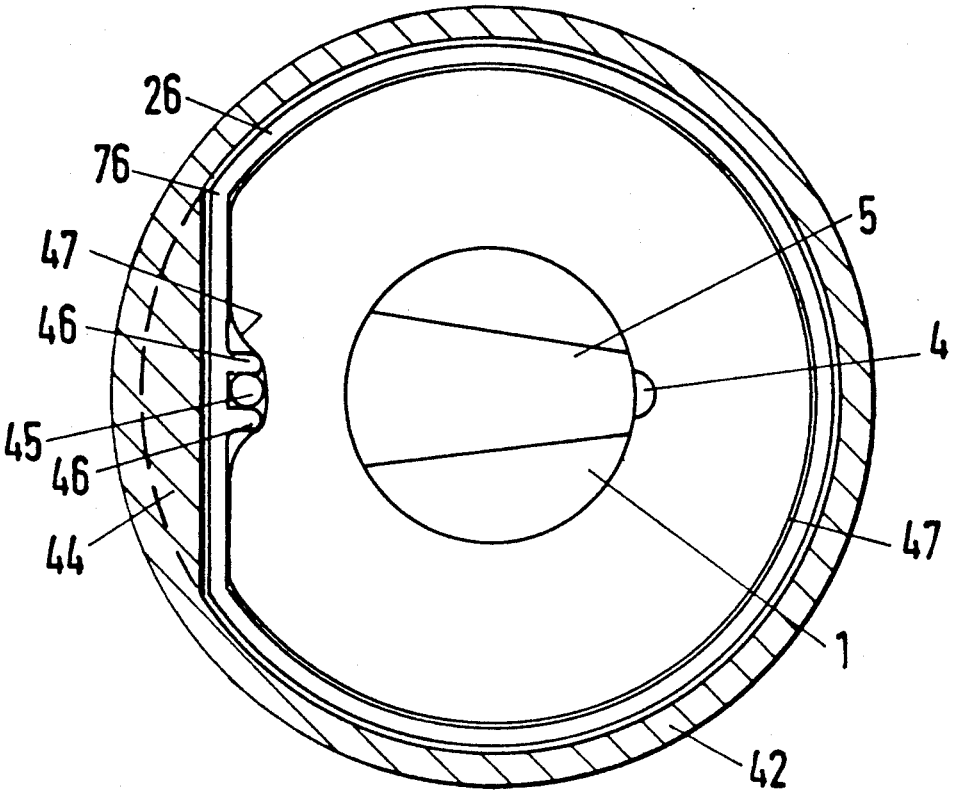
Figure 10:
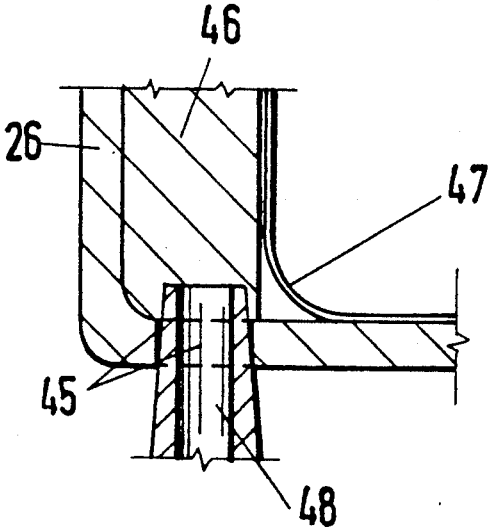

Further advantages, features and possible applications of the present invention are evident from the following description of preferred embodiments, given with the aid of the drawings, where:

FIG. 1 shows the broken off sectional view of the spray nozzle of a first embodiment in the closure position, FIG. 2 shows the same as in FIG. 1, but in the spraying position, FIG. 3 again shows the same as in FIGS. 1 and 2, but in the venting position, FIG. 4 shows a horizontal section through the valve mechanism which is fitted with a ball cage, with the control slider disposed adjacent thereto, FIG. 5 shows a vertical section through the spray nozzle with the energy part, switch, products container and the spray head, FIG. 6 shows the plan view of another embodiment of the invention, such as can be seen for example in FIG. 8, FIG. 7 shows a similar sectional view as those in FIGS. 1 to 3, wherein however another embodiment is shown, for example that shown in FIG. 8, FIG. 8 shows a similar vertical sectional view as FIG. 5, but here the view is of another embodiment with a foils container in the products container, FIG. 9 shows a similar plan view to that in FIG. 6, wherein however the products container in the left region thereof is shown with a broken off view inwardly, in particular with range spacers, FIG. 10 shows in a broken-off illustration a detail corresponding to the circular section in FIG. 8, and FIGS. 11 to 13 show further embodiments of the invention.

A first embodiment of a spray nozzle which is best recognisable from FIG. 5 is described with the aid of FIGS. 1 to 6.

In a casing cover 42, the shape of which forms a cylindrical casing, there is located between a bottom with a suction filter 38 and a base bottom 35 the energy part with batteries 39, a motor switch 34, direct current motor 36 and air pump 37 with pressure connections 60. The energy part receives the lower one third of the cylindrical casing cover 42. The upper two thirds are filled by a products container 26, which can likewise be in the form of a cylinder, but which is preferably flattened on one side so that a flat container surface 76 is formed there as shown in FIG. 6. The flat surface of the container serves in connection with an orientation screen 44 arranged on the casing cover 42 at the top thereof (FIG. 8) to correctly insert the products container 26.

The products container 26 is provided at the top thereof with a spray head generally labelled 1*a*. This is shown clearly on an enlarged scale in FIGS. 1 to 3. It comprises a closure part 2 which seals and surrounds the products container 26 at the upper outlet thereof, and which is provided at its top with a control part 1 and a nozzle receiver 3, in which a spray nozzle 4 sits. If FIGS. 1 to 5 are studied from top to bottom, as can be seen in FIG. 6, then the finger surface 5 of the control part 1 can be seen which is movable in the direction of the broken line longitudinal central axis 67 (FIG. 3) against the force of a return spring 15 towards the closure part 2. A stop ring 16 is located on the closure part 2, which stop ring can cooperate with a stop ring 17 on the control part 1, in such a way that when the control part 1 is released the return spring 15 adjusts the maximum distance of the control part 1 from the closure part. This distance is again located on the lower side of the control part 1, which is at its maximum in the closure position according to the illustration in FIG. 1 and represents the stroke H, whilst in the spraying position shown in FIG. 2, the distance has become nil. Here the stop rings 16 and 17 are at the distance of the stroke H from one another.

The spray head 1*a* also has mechanisms which allow the influx of compressed air into the spray nozzle 4, wherein amongst these mechanisms there is a slide valve including a passage 61 and a control slider 13 (and the afore-mentioned motor switch 34). As mentioned with the aid of FIG. 2 and the spraying position, it depends on the position of the control slider 13 whether a connection is made between the spray nozzle 4 and the air supply line 14, or whether this connection is interrupted.

The closure part 2 has a longitudinal central axis 67 which is also the longitudinal direction of the control slider 13. The oblong passage 61 in the closure part 2 is central and parallel to the longitudinal cental axis 67. Pipe connections 20, 21, 27 extend vertically to the longitudinal central axis 67 and radially outwardly from the passage 61, wherein 20 is the air supply channel for the spray nozzle which is shown as a two component vortexing system 24 (FIG. 3) with an opening 25 of a spineffect nozzle, 21 shows the air supply channel to the products container 26, and 27 shows the inlet to the spray nozzle 4. In the feed pipe receiver 6 in which the feed pipe 7 for the product is arranged, there is also connected thereto the products channel 51 which so to say lies in an extension of the passage 61 downwardly i.e. towards the side of the closure part 2 which is oppositely disposed to the return spring 15.

It can be seen that the control slider 13 is longer than the passage 61 itself, so that the passage 61 can be received by the control slider whatever its position.

At both ends of the control slider 13 there is respectively in the centre a passage 70 for air above extending in the direction of the longitudinal axis 67 and the central passage 71 for the liquid in the lower end body 63 of the control slider 13. The passage 70 for air is connected to the radially extending air supply channel 19 and the passage 71 for the liquid is connected to the pusher channel 22 of the control slider 13.

FIGS. 1 to 3 show an annular groove 18 adjacent to the downstream end of the air supply line 14, wherein this annular groove extends adjacent to the upper distribution space in the control slider in connection with it. The upper end of the control slider 13 is connected to the control part 1, so that the control slider 13 can push up and down against the force of the return springs 15 in the direction of the axis 67 together with the control part. The end of the air supply line 14 moves together with the control slider 13. The structure of the control slider is basically cylindrical and is only interrupted by pipe outlets such as for example the air supply channel 19 which is separated from the air passage 62 by a sealed reinforcement 30 provided with ventilation groove 28, which air passage 62 is in turn separated by the sealed swelling 29 from the pusher channel 22.

The closure part 2 is provided in the upper cup-shaped part thereof (with the stop ring 16 at the top) in the centre around the passage 61 with a hollow connection piece 64 which at the top on the inner side thereof bears an annular seal 31. In the closure position, this annular seal 31 cooperates with the sealed reinforcement 30. Inside the annular seal 31 there is located an annular space 65 for air flow which is made into a larger annular space by the air passage 62, by means of which annular space air can flow downwards in the spraying position of FIG. 2, and upwards in the venting position shown in FIG. 3.

In FIG. 5 it is possible to see the mirror of liquid and to the right on the lower part it is also possible to see the energy check light.

FIG. 1 shows to the left the air supply channel 20 extending from the longitudinal direction 67 of the control slider 13 or from the longitudinal central axis 67 of the closure part 2 and which extends radially outwardly at approximately 90°, and FIG. 2 shows same to the right. The inlet 27 has already been mentioned—it is directly connected to the products channel 23 of the spray nozzle 4.

FIGS. 1 to 3 show to the right of the closure part 2 and approximately opposite to the spray nozzle 4 the ball cage which is generally labelled 8. It holds the steel ball 9 over the runner 10. When opened, as shown in FIGS. 1 to 3, the steel ball 9 rests on the retaining cams 12, and in a sealed condition not shown, when the spray nozzle is for example so disposed that it is on its head, then the steel ball 9 is in its tight seat 11.

The products container 26 is arranged as shown in FIG. 5 on a sealed membrane 43 above the base 35 of the casing, and is held by a switch finger 68 by guide pins 69 against the force of the switch spring 33 in such a way that when the products container 26 is pushed down, the switch finger 68 activates the motor switch 34 so that the air pump 37 begins to work and conveys air over the pipe connections 60 through the air supply line 14 into the spray nozzle 1*a*.

FIG. 5 also shows the feedpipe 7 which is disposed in the liquid 52 contained in the products container 26. Clearly, the guide pin 69 has a stop below so that it always holds the switch spring 33 under a tension. A guide plate 40 is shown in the casing cover 42 at the bottom left.

Figure 11:
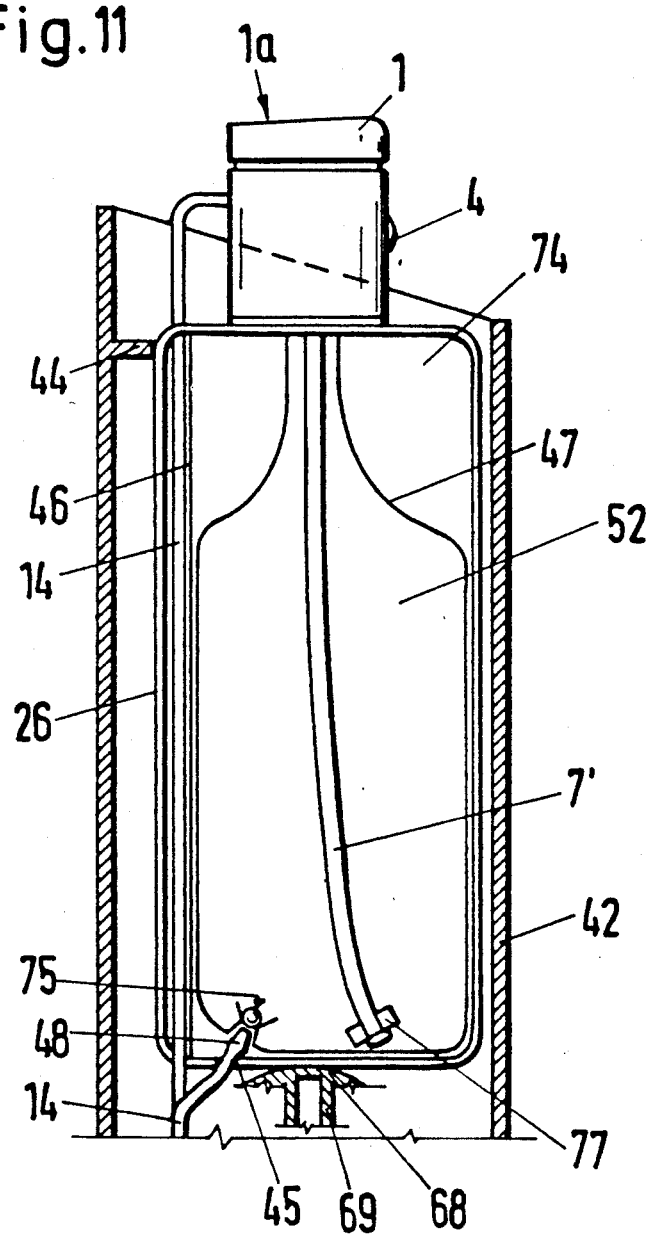

Other embodiments of the invention are described with the aid of FIGS. 7 and 11, wherein the same or corresponding parts are described with the same reference figures, so that a description of them does not need to be repeated.

The products container 26 also has, in all shown embodiments, a foils container 47 for the liquid 52 which is connected by a retaining groove 50 outside the products channel 51 by means of a retaining ring 49 so that it is sealed to the products channel 51 in such a way that from the outlet 72 of the foils container 47 no liquid can reach the inner space 74 of the products container 26. The inner space 74 of the products container is also dry. In FIG. 7 it is again possible to see the control slider 13 the upper end 73 of which, is connected to the control part 1, is however no longer provided with the recesses and passages such as are shown in the embodiment in FIGS. 1 to 3. The upper end part 73 of the control slider is instead closed, either by means of a corresponding outer casing or by a solid structure. By means of this design of the control slider 13 in accordance with FIG. 7 the air supply line 14 is not introduced at the top into the control part 1, but the downstream end is connected by the end connection 48 for air of the air supply line 14 to the inner space 74 of the products container 26, as shown in FIG. 8. In this connection, reference is made to the detail in the circle shown in FIG. 8, which is shown in FIG. 10. There it can clearly be seen that the end connection 48 for air of the air supply line 14 opens into the inner space 74 of the products container. In this way compressed air is introduced into the inner space 74 when the air pump 37 is activated.

Furthermore, an air supply channel 20′ can also be seen in FIG. 7 which leads from the inner space 74 of the products container 26 directly to the nozzle 4. The air supply channel (20′)—in connection with the air supply channel 21—serves to feed the spray nozzle 4 with air, whilst the liquid is supplied through the inlet 27 of the spray nozzle 4. The pressure of air in the inner space 74 has an effect on the one hand on the surface of the foils container 47 and on the other hand in the spray nozzle 4.

In order that the end connection 48 for air of the air supply line 14 as shown in FIGS. 8 and 10 is always exactly in the air inlet 45 of the products container when the products container 26 is in use, the products container should always be directed in a straight direction during the changing over procedure or insertion into the casing cover 42. The direction or orientation thereof is taken care of by the afore-mentioned orientation screen 44 which projects on the inside of the casing cover 42 radially and vertically by a portion, such as can be seen most clearly by the plan view in FIG. 6. In the plan view the orientation screen 44 has a segmented configuration or circular section with the straight edge 44′ which connect the two ends of the partially circularly bent edge 44″. The section of the casing cover 42 is visibly diminished by means of the segment-like orientation screen 44 so that the products container 26 too has a corresponding recess which is segment-like in section, thereby resulting in a flat container surface 76 which extends parallel to the straight end edge 44′ of the orientation screen 44 such as can be seen in FIG. 6. The recess of the products container 26, which recess is segment-like in cross-section, is disposed in the view shown in FIG. 6 below the orientation screen 44 and is labelled 76′ in FIG. 8.

Another embodiment of the invention is shown in FIG. 11. Here too the foils container 47 containing the liquid 52 is disposed in the products container 26, the outlet 72 of which foils container (FIG. 7) is connected and sealed to the products channel 51 (FIG. 7) by means of the retaining groove 50 and the securing ring 49. Contrary to the previously described embodiment according to FIGS. 7 and 8 according to FIG. 11 the foils container 47 is connected to a check valve 75 which is illustrated in FIG. 11 so that the excess pressure of the liquid 52 in the inner space of the foils container 47 keeps the check valve 75 closed and only the excess pressure from the air supply line 14 makes it possible to open the check valve 75 temporarily, so as to increase once again the pressure inside the foils container 47 which has been somewhat reduced, or to increase the pressure anyway. This check valve 75 can be seen to be connected with the downstream end, i.e. with the end connection 48 for air of the air supply line 14.

This embodiment shown in FIG. 11 is also connected to the orientation screen 44 because when the products container 26 is inserted, the position of the air inlet 45 in the products container 26 and the air supply line 14 must be very exactly arranged.

The foils container 47 is also provided here with a feedpipe 7′, which is preferably in the form of a tube, which can have a weight 77 at the open end of the feedpipe 7′, so that when the whole spray nozzle is arranged on its head, the tube opening is always kept in the liquid body 52.

With the embodiment shown in FIG. 11, the spray head 1*a* is not drawn on a larger scale. Therefore the embodiment shown in FIGS. 1 to 3 can be taken into consideration because a branch of the air supply line 14 extends in a similar way to the embodiment shown in FIGS. 8 to 10 between the range spacers 46 of the products container 26 upwards, so that the downstream end of the air supply line 14 is again connected in the vicinity of the air distribution space 66 connected to the air supply line in the control slider 13. Additionally, it is to be noted that the air supply channel 21 is closed and the ball cage 8 is missing. Therefore neither liquid nor compressed air can reach the space 74 of the products container. The products container can now only be opened above the products channel 51 by means of the control slider 13.

Another embodiment which is not illustrated has, like in FIG. 8, the foils container 47 which is able to be filled with the liquid 52 in the products container 26. The outlet 72 thereof is again connected and sealed to the products channel 51. However, the downstream end of the air supply line 14 is now connectable via the control slider 13 to the inner space 74 of the products container 26, which is true for both the embodiment of FIGS. 1 to 3 and for the embodiment shown in FIG. 7, except that the arrangement in FIG. 7 is not given but the modified embodiments in FIGS. 1 to 3, i.e. without a ball cage and with a closed air supply channel 21 so that the products container 26 can again only be opened above the products channel 51, and this by moving the control slider 13. This embodiment which is not shown and which has been described latterly is an alternative to that of FIG. 11 as far as the liquid 52 in the foils container 47 is pushed into the inner space 74 of the products container 26 into the spray head 1*a* by compressed air.

The spray nozzle operates as follows:

With the embodiment shown in FIGS. 1 to 5, the control part 1 is normally in the closure position of FIG. 1. By exerting finger pressure on the finger surface 5 of the control part 1, the control part is brought into the spray position in FIG. 2, and the compressed air supplied by the air supply line 14 is conveyed by an annular groove 18 into the control slider 13. It flows through the air supply channels 19 into the air supply channel 20 of the two-component vortexing system 24 and simultaneously into the air supply channel 21 of the products container 26. Owing to this exertion of pressure on the surface 32 of the liquid 52, the liquid product is conveyed via the feedpipe 7 into the pusher channels 22 and thence into the products channel 23 of the vortexing system 24. There then takes place here the vortexing of the product with the simultaneous inflow of air, so that a fine cloud of spray leaves the spray nozzle 4 through the vortex nozzle opening 25.

After the application of spray has ended, the return spring 15 pushes the control part 1 with the control slider 13 over the venting position (FIG. 3) once again into the closure position of FIG. 1 Path limitation (stroke H according to FIG. 1) is by means of the stop ring 16 of the closure part 2 of the spray nozzle and by means of the stop ring 17 of the control part 1.

In the venting position shown in FIG. 2, by means of the declining pressure on the finger surface 5 and also because of the reduced pressure in the inner space 74 of the products container, the introduction of air into the spray nozzle 4 is interrupted. This happens by means of the motor switch 34 in the bottom of the casing 35 of the spray nozzle. Simultaneously the inlet 27 of the products channel 23 for the vortexing system 24 is closed by the lower part of the control slider 13. The excess pressure which is still present in the head room of the products container 26 is promptly released by the venting groove 28 (FIG. 3). This prompt reduction in pressure above the liquid 32 is very important because thereby any subsequent spraying of the product through the spray nozzle 4 is avoided.

When further finger pressure is released from the finger surface 5 or when the pressure in the inner space 74 the control slider 13 again enters the closure position shown in FIG. 1, wherein now both the air supply channels 20 and 21 are closed by the sealed reinforcement 29 of the control slider 13. Furthermore, the whole area is still fluid tight to the air supply channels 19 by means of sealed reinforcement 30 of the control slider 13 and by means of the annular seal 31. This is advantageous because whatever the position of the spray nozzle the liquid cannot enter the air pump 37 via the air supply channels 19 and air supply line 14.

The ball cage 8 with the steel ball 9 serves this purpose, which prevents liquid flowing into the air supply system when the spray nozzle is held horizontally or on its head. With the unit is in an oblique position at more than 90° the steel ball 9 rolls over the track 10 into the sealed seat 11, and thereby closes the air supply channel 21 for the products container 26.

If the products container is in the spraying position shown in FIG. 2, and held horizontally or on its head, then the air flowing in prevents the liquid from coming from the products container 26 into the air supply channel 21. If the spraying process is interrupted in this position, then it can happen that as a result of the inner pressure in the products container 26 a small amount of liquid enters the air supply channel 21, before the sealed reinforcement 29 can effectively close this channel. This occurrence is prevented in the way described by means of the ball cages.

If the apparatus is brought back from the horizontal or upside-down position into a position which is more vertical, then the steel ball 9 falls down into its starting position, wherein it is held by the retaining fingers 12 cam.

When the apparatus is moved frantically up and down or horizontally backwards and forwards, the ball moves in the same direction as the liquid and thus effectively closes the sealed seat 11 to advantage before the liquid can reach the air supply channel 21.

The orientation screen 44 in FIG. 6 forces the correct orientation of the products container 26 when it is placed in the casing cover 42. In this way, it is also ensured that the spraying direction is always in the extension of the finger surface 5.

With the embodiment shown in FIGS. 7 to 10, which differ from the preceding example, there is no feedpipe 7, for example. Instead, the foils container 57 of plastics material which is on the outside of the feedpipe receiver 6 or outside the product channel 51 is in the form of a resilient sack or bag made preferably of a strong foil of very resilient material of a few.

If pressure is again exerted on the finger surface 5 of the control part 1, then when the control slider 13 is first pushed down, the motor 36 and the air pump 37 are thereby switched on so that compressed air can flow through the air supply line 14 and the air end pipe 48 into the products container 46. The end conection 48 for air sits and is sealed in the air inlet 45 of the products container 26. Therefore, the compressed air collects outside the foils container 47 and compresses it in such a way that the product 52 contained in the foils container 47 is conveyed through the products channel 51 into the inlet 27 and into the spray nozzle 4. The air which is simultaneously introduced through the air supply channels 19, 20, 21 also reaches the spray nozzle 4 so that the spray jet is promptly activated.

The foil container 47 can practically perform the function of the feedpipe, but with the following very considerable advantages: the spray unit can spray the contents properly whatever the position, thus even upside down. There is no possibility of the liquid reaching the air conveying passages.

Depending on the elasticity or capacity to return of the foils container 47 the liquid 52 in the products channel 51 is always such that there is no delay whatsoever on the spray effect after exerting pressure on the finger surface 5.

The embodiment in FIG. 11 operates in such a way that when the finger pushes the control part 1 the motor switch 34 activates the air pump 37 and conveys compressed air into two sections. Firstly, it is conveyed over the end connection 48 for air and the return valve 75 into the inside of the foils container 47, whereby the pressure exerted therein pushes the liquid 52 up into the spray head 1*a*. Secondly, the compressed air reaches the air distribution space 33 in the control slider 13 via the air supply line 14, and is thence (when the air supply channel 21 is closed) conveyed via the air supply channel 19 into the air flow space 65, past the air passage 62 of the control slider 13 into the air supply channel 20 of the spray nozzle 4.

It can be imagined that the increase in pressure by means of the air flowing into the air supply line 14 is generally very fast, so that one can speak of a prompt activation of the spray jet when the finger surface is pressed. This prompt activation of the spray jet is particularly successful when the products container 26 is full.

If spraying occurs at very many intervals, such as for example when styling hair, as mentioned above, then compared with aerosols and their inherent environment unfriendly propellant gases short delays can occur when using and producing the spray jet particularly if the products container 26 is only half full or nearly empty. This is partly to be explained because in order to fill the head room or the inner space 54 of the products container 26, the build-up in pressure and filling of the products channel and the spraying system require a certain time, for example one second. This can mean that in certain circumstances there is an inconvenient delay for the hairdresser.

Therefore, in order to create a faster build-up in pressure and particularly in order to apply the liquid over a shorter period of time after venting, it is advantageous if the spray nozzle according to the invention of the kind mentioned in the introduction has in the products channel of the closure part a check valve distanced from the inlet directed to the spray nozzle. This check valve can for example be in the form of a sealed seat for a steel ball, which sealed seat is disposed (when the spray nozzle is upright vertically) at the upper end of the feed pipe. This check valve thus ensures that when the spray is switched off, i.e. when the finger pressure has been removed from the control part to close the apparatus, then the product is prevented from falling below the liquid threshold in the feedpipe. Experiments have shown that the liquid threshold in the feedpipe is maintained for a number of days. This kind of sealing is satisfactory however if the liquid threshold is maintained for a few seconds, because the interval during critical applications is shorter than this time.

By means of the newly designed spray nozzle with the check valve which is distanced from the inlet in the products channel of the closure part, the application of liquid is therefore more quickly activated and the whole spray nozzle is easier to handle.

Figure 12:
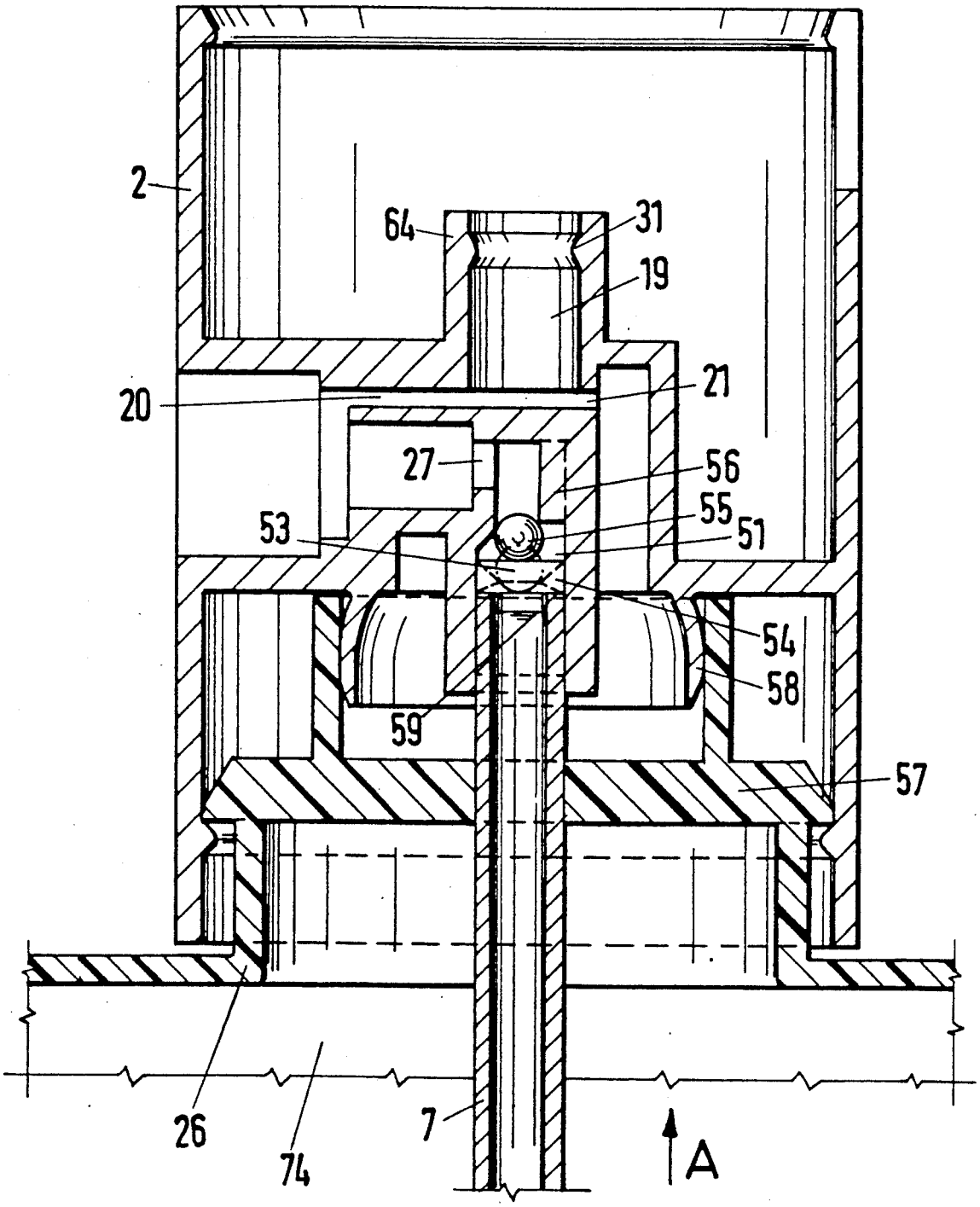
Figure 13:
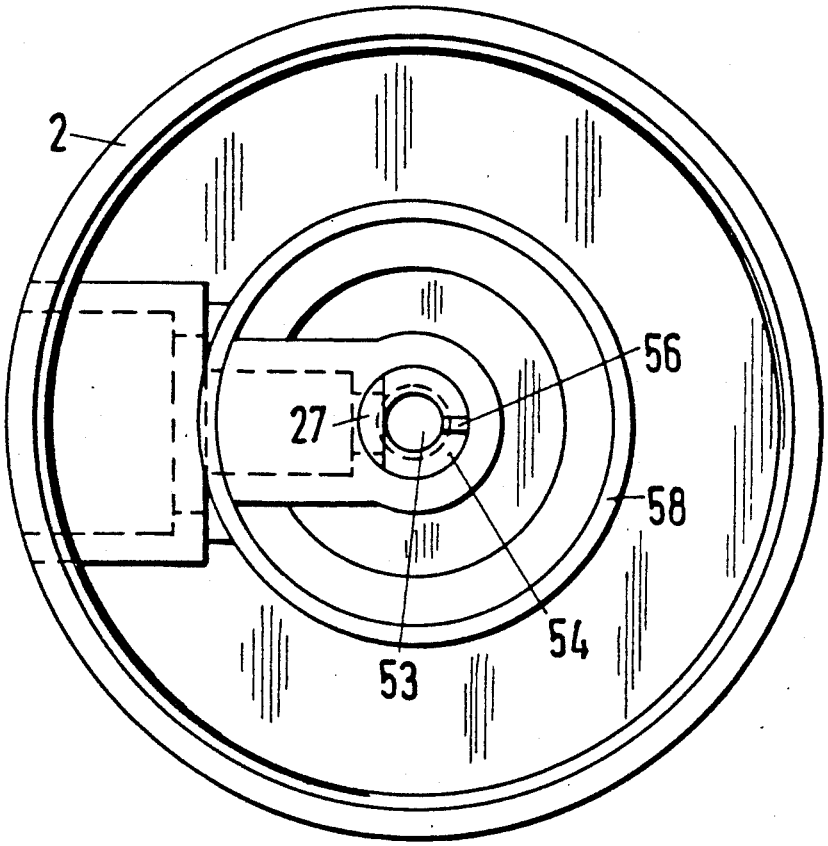

FIGS. 12 and 13 show this new embodiment of the spray nozzle, and FIG. 12 shows a broken off vertical section of the upper part of the products container without the control part, and FIG. 13 shows a view A on FIG. 12 from below, wherein however the products container 26 is omitted.

In a similar way to the embodiments described already, the closure part 2 of the products container 26 is pushed over the clamping reinforcement 57 and snapped shut beneath it so that it cannot be released. The clamping reinforcement 57 is annular and hollow in the centre so that a feed pipe 7 can pass freely therethrough. Somewhere in the region of the inner circumference of the clamping reinforcement 57 a hollow cylinder projects up, in which cylinder an annular sealing lip 58 is clamped to the products container 26. This serves to hold the closure part 2 properly in place after it is clamped by means of the clamping reinforcement 57. Coaxially in the closure part 2, it is possible to see within the sealing lip 58 a hollow cylindrical part which forms the products channel 51. Here is also disposed the so-called upper end of the feedpipe 7 which is provided with the sealed seat 54. When the apparatus is closed, the steel ball 53 marked by means of an unbroken line lies in the sealed seat, which steel ball is raised during the spraying process into the position 55 marked by the solid line. The check valve is thus closed when the steel ball 53 is in the sealed seat 54.

In the spraying position, if the liquid in the feed pipe 7 pushes the steel ball into the upper position 55, the latter is obstructed by a stop 56 at the furthest run-up, so that the ball 53 cannot for example close the inlet 27 of the products channel 23.

In the upper central region of the closure part 2 it is again possible to see the hollow connection piece 64 with the annular seal 31. Here, the upper part of the control slider 13 which is shown for example by the embodiment in FIG. 1, is pushed by means of the control part 1 (not shown), or is thus pushed in the spraying position such that compressed air can flow from the air supply line 14 over the air distribution space 66 in the control slide 13 and over the central passage 70 down into the air supply channel 20 of the spray nozzle 4.

What is claimed is:

1. A spray apparatus for spraying or frothing liquid products having a products container (26) disposed in a casing cover (42) and having a spray head (1*a*, 1–5) which is provided with a channel (51) for the products, and an air supply line (14) having one end connected to a pressure connection (60) of an air pump (37), said spray head (1*a*, 1–5) has a closure part (2), a control part (1) which is displaceable towards said closure part, and mechanisms (13, 34) for introducing compressed air into a nozzle (4) of said spray head (1*a*, 1–5), said spray apparatus being characterized in that said closure part (2) has a slide valve comprising a passageway (61) and a control slider (13), said passageway (61) having an upper annular recess (65), and said passageway (61)

being in communication with a first air connection (20) and with a liquid products connection (27), where said first air connection (20) and said liquid products connection (27) lead to said nozzle (4), and said control slider (13) is slidably received in said passageway (61), movable by means of said control part (1) and prestressed by a return spring (15), said control slider (13) having a connecting passage (62), products passage means (22, 71), venting passage (28), and upper (30) and lower (29) sealed reinforcements, said apparatus further comprising air supply passage means (70, 19, 21') for supplying air pressure from said air supply line (14) to said passageway (61), said control slider (13) being cooperable with said passageway (61), such that when said control part (1) is in a spraying position, said control slider (13) is axially positioned within said passageway (61) such that said connecting passage (62) of said control slider (13) connects said first air connection (20) in said closure part (2) to said air supply passage means (70, 19, 21'), and said products passage means (22, 71) is connected to said liquid products connection (27), and when said control part (1) is in a venting position, said control slider (13) is axially positioned within said passageway (61) such that said liquid products connection (27) in said closure part (2) is sealed by said control slider (13), and said first air connection (20) is vented to the atmosphere through said connecting passage (62) and venting passage (28), and when in a closure position, said control slider (13) is in its uppermost position in said passageway (61), and said liquid products connection (27) and said first air connection (20) are sealed by said control slider (13).

2. A spray apparatus according to claim 1, characterized in that said control slider (13) further comprises a second air connection (21) axially disposed in said passageway (61) proximate to said first air connection (20) and communicating with said products container (26), such that when said control slider (13) is in said spraying position, said connecting passage (62) pressurizes said first and second air passages (20, 21).

3. A spray apparatus according to claim 2, characterized in that said lower sealed reinforcement (29) is medially positioned between said connecting passage (62) of said control slider (13) and said products passage (22), said lower sealed reinforcement (29) being adapted to cooperate with said control slider (13) to seal said first and second air connections (20, 21) in said closure part (2), when said control slider (13) is in said closure position.

4. A spray apparatus according to claim 2, characterized in that said passageway (61) in said closure part (2) is disposed centrally and parallel to a that said first and second air connections (20, 21) of said closure part (2) extend radially from said passageway (61), in that said products channel (51) is provided in a lower extension of said passageway (61), in that said control slider (13) is longer than said passageway (61), and said air supply passage means comprises a first and second bore (19, 70) at an upper end of said control slider (13), said first and second bore being in communication with said air supply line (14), such that pressure from an opposite end of said air supply line (14) is connectable by means of said control slider (13) to said nozzle (4) and to an inner space (74) of said products container (26).

5. A spray apparatus according to claim 2, characterized in that said second air connection (21) in said closure part is interconnected to said products container (26) via a valve mechanism (8–12).

6. A spray apparatus according to claim 5, characterized in that said valve mechanism has a ball cage (8) comprising a valve ball (9) held by retaining cams (12) on runners (10), said valve ball being movable from a position against said retaining cams (12) to a sealing position against a tight seat (11).

7. A spray apparatus according to claim 1, characterized in that said connecting passage (62) of said control slider (13) is formed by an annular recess in said control slider (13), having a length at least as long as a stroke length (H) of said control part (1).

8. A spray apparatus according to claim 1, characterized in that an upper end of said passageway (61) includes an annular seal (31) adapted to cooperate with said upper sealed reinforcement (30) of said control slider (13), to seal said connecting passage (62) in said closure position.

9. A spray apparatus according to claim 1, characterized in that said upper sealed reinforcement (30) is medially positioned between said venting passage (28) of said control slider (13) and said connecting passage (62), and is profiled to cooperate with an annular seal (31) disposed on said closure part (2) in a sealing tight engagement.

10. A spray apparatus according to claim 1, characterized in that said products container (26) is movably disposed in said casing cover (42) and is held on a spring loaded switch finger (68) which is pre-stressed against said casing cover (42) to activate a motor switch (34).

11. A spray apparatus according to claim 1, characterized in that a switch finger (68) is secured to a displaceable guide pin (69), said switch finger (68) and displaceable guide pin (69) being supported above a bottom casing (35) by means of a switch spring (33).

12. A spray apparatus according to claim 11, characterized in that said switch spring (33) has a higher spring constant than said return spring (15) which prestresses said control slider (13) against said closure part (2).

13. A spray apparatus according to one of claims 1, or 7–12, characterized in that a foil container (47) is secured in said products container (26) and can be filled with liquids (52), an outlet (72) of said foil container (47) is sealingly connected to said products channel (51), in that an upper end part (73) of said control slider (13) which is connected to said control part (1) of said spray head (1A) is closed and without a passage for air, in that a downstream end of said air supply line (14) opens into an inner space (74) of said products container (26), and said air supply passage means comprises an air passage (21') extending through said closure part (2) and into said passageway (61), interconnecting said inner space (74) of said products container (26) with said passageway (61).

14. A spray apparatus according to one of claims 1, or 7–12, characterized in that a foil container (47) is secured in said products container (26) which can be filled with liquids (52), an outlet (72) of said foil container is sealingly connected to said products channel (51), and said foil container is provided with a check valve (75) connected to a downstream end of said air supply line (14) and with a feed pipe (7), and in that said products container (26) can only be opened above said products channel (51) by means of said control slider (13).

15. A spray apparatus according to one of claims 1, or 7–12, characterized in that said air supply passage means comprises first and second bores (19, 70) through said control slider (13) adjacent to an upper end of said control slider (13), a foil container (47) is secured in said products container (26) which can be filled with liquids (52), an outlet (72) of said foil container is sealingly connected to said products channel (51), and said foil container is provided with a check valve (75), said first and second bores (19, 70) are connected to a downstream end of said air supply line (14) such that said air supply line (14) supplies pressure to said foil container (47) and to said nozzle (4) by way of said control slider (13).

16. A spray apparatus according to one of claims 1, or 7–12, characterized in that a foil container (47) is secured in said products container (26) which can be filled with liquids (52), an outlet (72) of said foil container is sealingly connected to said products channel (51), in that a downstream end of said air supply line (14) is connectable by said control slider (13) to an inner space (74) of said products container (26), and in that said products container (26) can only be opened above said products channel (51) by means of said control slider (13).

17. A spray apparatus according to claim 16, characterized in that said casing cover (42) is provided with an orientation screen (44) which reduces its cross-section, in accordance with which said products container (26) has a recess on the outside thereof.

18. A spray apparatus according to claim 17, characterized in that there is a feed pipe (7) in the form of a tube, having a weight mounted to an end thereof.

19. A spray apparatus for spraying or foaming liquid products having a products container (26) disposed in a casing cover (42), a spray head (1*a*, 1–5), and an air supply line (14) connected to a pressure connection (60) of an air pump (37), said spray head (1*a*, 1–5) comprising a closure part (2) provided with a products channel (51), a control part (1) displaceable towards said closure part (2), and mechanisms (13, 34) for introducing compressed air into a spray nozzle (4) of said spray head (1*a*, 1–5), characterized in that: a check valve (53–55) is arranged in said products channel (51) of said closure part (2), and is operable independently of said control part (1) and said mechanisms (13, 34), and which is distanced from an inlet (27) of said spray nozzle (4) and directed towards said spray nozzle (4).

* * * * *